US009022073B2

(12) United States Patent
Strauli

(10) Patent No.: US 9,022,073 B2
(45) Date of Patent: May 5, 2015

(54) DEVICE AND METHOD FOR USE IN A SHOWER SYSTEM

(76) Inventor: Urs Strauli, Stettfurt (CH)

( * ) Notice: Subject to any disclaimer, the term of this patent is extended or adjusted under 35 U.S.C. 154(b) by 238 days.

(21) Appl. No.: 13/142,710

(22) PCT Filed: Dec. 18, 2009

(86) PCT No.: PCT/EP2009/009146

§ 371 (c)(1),
(2), (4) Date: Oct. 13, 2011

(87) PCT Pub. No.: WO2010/075987

PCT Pub. Date: Jul. 8, 2010

(65) Prior Publication Data

US 2012/0018000 A1 Jan. 26, 2012

(30) Foreign Application Priority Data

Dec. 30, 2008 (EP) ..... 08022554

(51) Int. Cl.
*B01F 5/04* (2006.01)
*E03C 1/046* (2006.01)
*F04F 5/46* (2006.01)

(52) U.S. Cl.
CPC ..... *E03C 1/046* (2013.01); *F04F 5/463* (2013.01); *Y10S 4/903* (2013.01)

(58) Field of Classification Search
CPC ..... E03C 1/046
USPC ..... 137/268, 888, 892, 893, 891, 897; 239/310, 318; 251/208; 4/605, 903
See application file for complete search history.

(56) References Cited

U.S. PATENT DOCUMENTS

| | | | | | |
|---|---|---|---|---|---|
| 2,531,480 | A | * | 11/1950 | Sparklin et al. | 251/208 |
| 2,562,415 | A | * | 7/1951 | Chase | 137/625.28 |
| 3,207,445 | A | | 9/1965 | Court et al. | |
| 3,763,888 | A | * | 10/1973 | Duecker | 137/893 |
| 4,121,773 | A | * | 10/1978 | Headen et al. | 239/317 |
| 4,218,013 | A | * | 8/1980 | Davison | 239/74 |
| 4,623,095 | A | * | 11/1986 | Pronk | 239/311 |
| 4,901,765 | A | * | 2/1990 | Poe | 137/893 |
| 5,333,789 | A | * | 8/1994 | Garneys | 239/318 |
| 5,716,006 | A | | 2/1998 | Lott | |
| 5,913,327 | A | * | 6/1999 | Zhadanov et al. | 137/205.5 |
| 6,036,110 | A | * | 3/2000 | Kanatzar et al. | 239/317 |
| 6,419,166 | B1 | * | 7/2002 | Brzezinski et al. | 239/310 |
| 6,571,989 | B1 | * | 6/2003 | Jiang | 222/145.7 |

(Continued)

FOREIGN PATENT DOCUMENTS

| | | | |
|---|---|---|---|
| EP | 1 031 665 | A2 | 8/2000 |
| FR | 2 620 470 | A1 | 3/1989 |
| JP | 2000-197575 | A | 7/2000 |

OTHER PUBLICATIONS

International Search Report for International Application No. PCT/EP2009/009146, mailed Apr. 7, 2010.

(Continued)

*Primary Examiner* — Kevin Murphy
(74) *Attorney, Agent, or Firm* — Alston & Bird LLP

(57) ABSTRACT

Provided is a device for use in a shower system and a related method. The device may include an appliance for adding a medium to shower water. The appliance may be designed such that it works according to the principle of a water jet pump. Advantageously, the medium added to the shower water may contain one or more fragrance media.

11 Claims, 7 Drawing Sheets

(56) References Cited

U.S. PATENT DOCUMENTS

| | | | | |
|---|---|---|---|---|
| 7,028,922 | B2 * | 4/2006 | Leonard et al. | 239/318 |
| 7,201,331 | B2 * | 4/2007 | Bertrand | 239/318 |
| 2003/0189106 | A1 | 10/2003 | Cernik | |

OTHER PUBLICATIONS

International Preliminary Report on Patentability for International Application No. PCT/EP2009/009146, completed Apr. 12, 2011.

Written Opinion from International Application No. PCT/EP2009/009146, dated Apr. 7, 2010.

European Search Report from European Patent Application No. 10013814.8, dated Feb. 11, 2011.

European Search Report from European Patent Application No. 08022554.3, dated Jun. 15, 2009.

* cited by examiner

DEVICE AND METHOD FOR USE IN A SHOWER SYSTEM

CROSS REFERENCE TO RELATED APPLICATIONS

This application is a national stage application filed under 35 U.S.C. §371 of International Application No. PCT/EP2009/009146, filed Dec. 18, 2009, which claims priority from European Patent Application No. 08022554.3, filed Dec. 30, 2008.

The invention relates to a shower system, to a device for use in a shower system and to a related method.

Shower or douche systems are typical components of modern bath rooms.

Ordinary shower or douche systems enable the "sprinkling" of a person using the shower or douche system with cold, warm or hot water.

The water is supplied to the respective shower system generally via a mixer tap, also called mixing faucet, or via a mixing fitting or mixing valve.

Technical apparatus in which valves which are operated by one or several handles control the mixing of liquids or gases, i.e. in the case of shower systems the mixing of hot and cold water, are referred to as mixer taps or mixing fittings.

The sprinkling with water in a shower system serves in particular the personal hygiene but also serves the relaxation and the well-being.

Nowadays, the taking of a shower substitutes, to a certain extent, the taking of a bath. Numerous apartments or flats are not provided any longer with a bath tub, but only with a shower cubicle or cabinet.

There are free-standing or separate shower cubicles or cabinets with a small tub, but also showers integrated into bath tubs.

Frequently, showers are separated from the surroundings by waterproof curtains ("shower curtains"), sliding doors or also pivoted doors in order to protect the surroundings from splashing water. Shower cubicles are typically open to the top. Mostly, the walls are tiled and grouted.

Floor-level showers or walk-in showers are more complicated and expensive to construct. Therein the walls and the floor of the shower area are tiled or otherwise clad in a watertight manner; the floor is slightly inclined towards the drain. Said design also renders possible the use of the shower with wheelchairs or other walking aids. Further additions adapted to the needs of the disabled can be seating accommodations and grab handles.

Furthermore, there are known open large-capacity showers which are installed for instance in public baths or swimming baths, and so on.

Today's showers often comprise massage showers (shower heads) which are supplied with warm and/or cold water from a one-hand or single-lever mixer tap.

The usual accessories for taking a shower are soap, shampoo, shower gel, shower cap, bath brush, etc.

The object of the invention is to provide an innovative device for use in a shower system, an innovative shower system, and an innovative method for use in a shower system.

Advantageous further developments of the invention are mentioned in the subclaims.

In accordance with one aspect of the invention there is provided a device for use in a shower system which has an appliance for adding a medium to the shower water.

The appliance can be designed such that it works according to the principle of a water jet pump.

Advantageously, the medium added to the shower water contains one or more fragrance media, and/or one or more detergents, and/or one or more coloring agents, etc., etc., etc.

The medium can be provided by means of a supply means which can for instance comprise a capsule or cartridge.

Advantageously, the appliance for adding the medium to the shower water can be designed such that the supply means, in particular the capsule, is replaceable or exchangeable.

Thereby in each showering process different (fragrance) media, respectively, can be admixed to the shower water.

The invention will now be described in more detail by means of several embodiments as well as by means of the accompanying drawings in which:

FIG. 1 shows, in a diagrammatic and exemplary manner, a device 1 for use in a shower system according to an embodiment of the present invention.

The device 1 can principally be used in any shower system, for instance in a shower system with shower cubicle, in a floor-level shower, in a large-capacity shower, etc.

Alternatively, the device can also be integrated in a bath tub, in particular in a bath tub provided with a shower system.

The above-mentioned shower cubicle, the above-mentioned floor-level shower, the above-mentioned bath tub, the above-mentioned large-capacity shower, etc., can be located for instance in a bath room of an apartment or a flat or of a residential house, or at any other place, for instance in a public or private swimming bath or bathing establishment, in a hotel, in a fitness center, in the shower rooms of a sports club, etc., etc.

Figure 1:
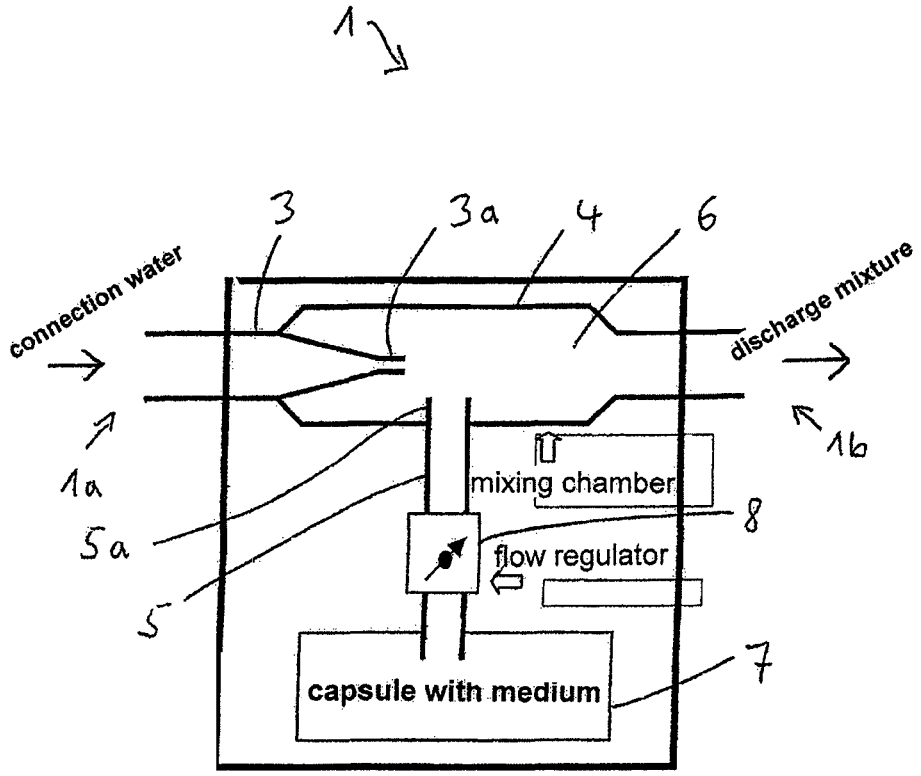
FIG. 1 is a diagrammatic, exemplary representation of a device for use in a shower system according to an embodiment of the present invention.

As is shown in FIG. 1, the device has a water connection 1*a* and a water discharge 1*b*.

Figure 2:
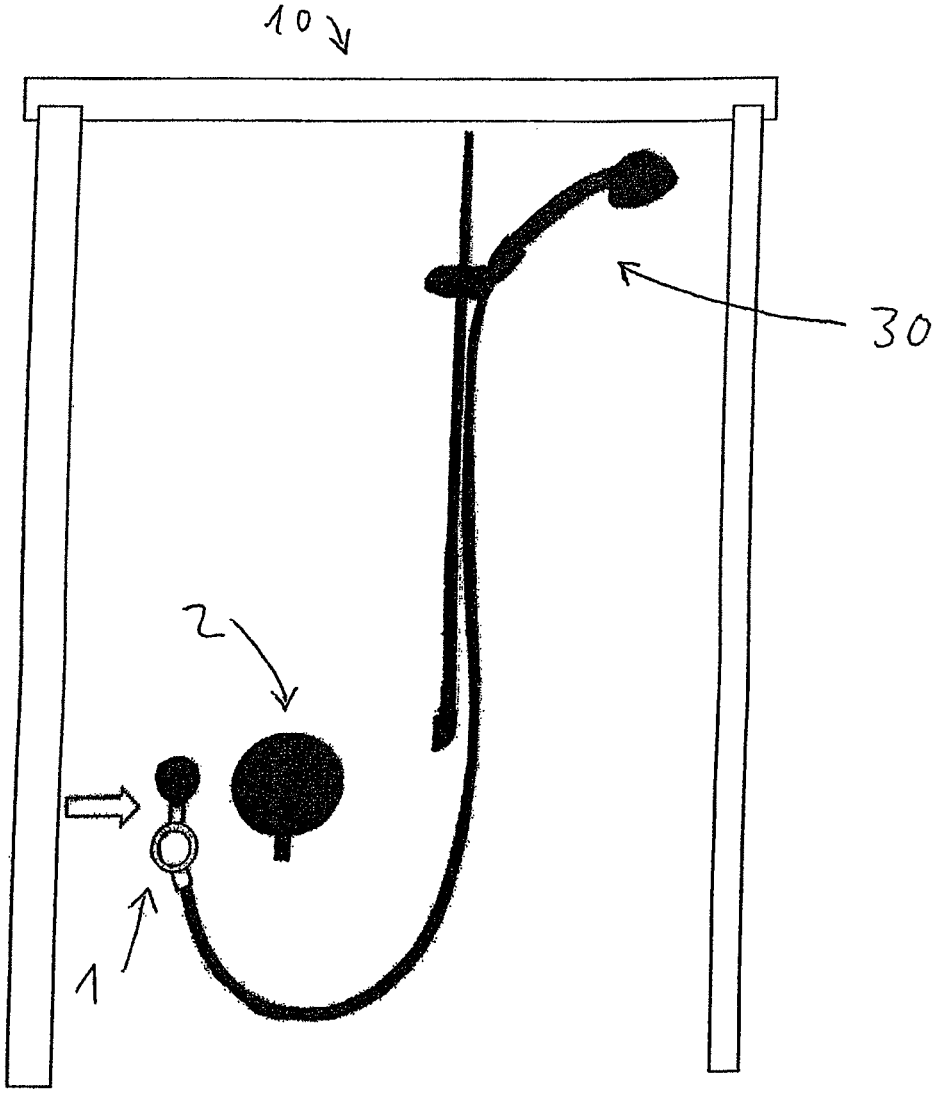
FIG. 2 is a diagrammatic, exemplary representation of a shower system according to an embodiment of the present invention.

Water can be supplied to the water connection 1*a* for instance, as shown in FIG. 2, via a mixer tap or a mixing fitting 2 of a shower 10, said mixer tap or mixing fitting 2 being connected with the device 1 via a pipe or a tube.

Into the mixer tap or the mixing fitting 2 there can be introduced correspondingly hot water via a hot water supply and cold water via a cold water supply.

In the mixer tap or the mixing fitting 2, the mixing of the hot and cold water can be controlled by means of valves which are operated by one or several handles.

In this manner, the temperature of the water supplied to the water connection 1*a* of the device 1 via the mixer tap or mixing fitting 2 and/or the amount of water supplied to the water connection 1*a* of the device can be adjusted according to the wishes of the respective user of the device 1.

As a mixer tap or a mixing fitting there can principally be used any mixer tap or mixing fitting, for instance according to FIG. 2 a one-hand or single-lever mixer tap with or without thermostat, or any other mixer tap, for instance a mixer tap with sensor control instead of lever control. The mixing tap can for instance be arranged in the bath room or at any other place, for instance in the basement.

In further alternative embodiments, the device 1 can also be integrated together with and in a mixer tap or a mixing fitting.

The water discharge 1*b* of the device 1 as shown in FIG. 1 can be connected by means of a pipe or a tube with a shower head 30, for instance as shown in FIG. 2 with a shower head 30 of a hand shower which can be removed from a holder attached at the wall of the shower 10, or, as an alternative, with a shower head fixedly mounted at the wall or at the ceiling of the shower.

In further alternative embodiments, the device 1 can also be integrated together with and in a shower head.

The device 1 works according to the concept of a water jet pump, which will be explained in detail in the following under reference to FIG. 1.

A water jet pump has two inlets and one outlet and, in principle, consists of two pipes 3, 4 fitted into each other.

The pipes 3, 4 have diameters of different sizes.

A suction line 5 is connected with the pipe 4 having the larger diameter The above-mentioned water connection 1*a* of the device 1 acts as the first inlet of the water jet pump, and as the second inlet the outlet of the suction line 5, for instance a corresponding vacuum outlet 5*a*.

The water discharge 1*b* of the device 1 constitutes the outlet of the water jet pump.

As is illustrated in FIG. 1, at the outlet of the pipe 3 there is provided a nozzle 3*a* ("propelling nozzle").

The diameter or the cross-section $A_2$ of the nozzle 3*a* is smaller than the diameter or cross-section $A_1$ of the pipe 3.

The water supplied via the first inlet of the water jet pump, i.e. via the above-mentioned water connection 1*a*, is fed via the nozzle 3*a* to a mixing chamber 6 formed by the pipe 4.

According to the so-called Venturi effect or the so-called Bernoulli's equation, due to the above-mentioned small diameter or cross-section $A_2$ of the nozzle 3*a*, i.e. due the narrowing formed by it, the flow velocity $v_2$ of the water is higher at that location than the flow velocity $v_1$ of the water in the pipe 3, and the pressure $p_2$ is lower at that location than the pressure $p_1$ in the pipe 3—at the location of the nozzle 3*a* (and, thus, also in the mixing chamber 6) a negative pressure $p_2$ is created.

By the negative pressure, a medium ("suction medium") provided by means of a supply means 7 is sucked in via the suction line 5, said medium being supplied via the above-mentioned outlet, in particular the vacuum outlet 5*a* of the suction line 5, to the mixing chamber 6.

In the mixing chamber 6, between the water flowing in rapidly via the nozzle 3*a* and the surrounding medium supplied via the suction line 5 there are caused turbulences by friction; as a result thereof a mixing of the medium supplied via the suction line 5 and of the water flowing in via the nozzle 3*a* will take place. In this process kinetic energy from the water jet will be transferred to the surrounding medium, whereby an effective conveying mechanism is provided. Furthermore, alternatively, correspondingly as in conventional water jet pumps, a nebulizing process can be effected so that then a corresponding spray mist—containing water and the added medium—will exit at the water discharge 1*b* of the device 1 (for instance in case of a correspondingly different design of the water discharge 1*b*).

The medium provided via the supply means 7 is preferably a liquid containing one or more deliberately added fragrances (or, alternatively, for instance a gas containing one or more deliberately added fragrances).

As a fragrance there can be used for instance any fragrance which is otherwise usually added to corresponding perfumes, soaps, shampoos, shower gels, deodorants.

For instance, similar to perfumes, etc., the (fragrance) medium provided via the supply means 7 can comprise alcohol, and/or water, in particular distilled water, and natural essences dissolved therein, for instance essential oils of plant and/or animal origin, and/or synthetically produced fragrances, for instance synthetic essential oils or smelling substances.

Due to different fractions of the elementary substances, the fragrance medium provided via the supply means 7, respectively, can have quite a lot of different fragrance notes, for instance, corresponding floral-feminine, masculine, oriental, fruity, powdery, citrus-fresh or classical-elegant nuances of fragrances, etc., etc.

For instance, from the available amount of approximately 200 natural essences and approximately 2,000 synthetic fragrances, there can be compounded 2 to 150, in particular for instance 10 to 100, advantageously 30 to 80 different substances for a corresponding fragrance medium composition.

The fragrance medium composition can, for instance,—in a correspondingly similar manner as in perfumes, soaps, shampoos, shower gels, deodorants—be formed such that fragrance components are used which remind of blossoms, fruits, spices, bark and resin, leaves, grasses, mosses, berries, roots, animal secretions and so-called Gourmand notes, etc.

As is furthermore shown in FIG. 1, a flow regulator 8 is provided at the suction line 5.

By said flow regulator 8, the diameter or the cross-section of the suction line 5 or of an opening of a valve provided therein can be changed in a variable manner and, thus, the amount of the fragrance medium sucked in by the mixing chamber 6 and then mixed with the water can be adjusted.

By means of the flow regulator 8 the suction line 5 can also be closed completely and, thereby, the mixing chamber 6 can be separated from the supply means 7, so that the water flowing into the mixing chamber 6 via the nozzle 3*a* will then be passed on to the water discharge 1*b* of the device 1 in an unmixed state.

Thus, the user of the device 1 is able to choose in a variable manner via the flow regulator 8 whether and how strong, i.e. to what extent, the water flowing in via the nozzle 3*a* shall be mixed respectively with a corresponding fragrance medium which is provided via the supply means 7. In other words, the user of the device 1 can variably choose whether and to what extent the water used by him or her for taking a shower shall be fragrant. Furthermore, via the flow regulator 8 it can be indirectly set how long the water shall be mixed with the fragrance medium (namely, where appropriate, until the supply means 7 is empty, which will happen the sooner the stronger the water will be mixed with the fragrance medium).

Alternatively or in addition to the above-mentioned fragrances, the medium respectively provided via the supply means 7 can also comprise components of shampoos, soaps, shower gels, etc., i.e.—apart from water—corresponding detergent base materials or detergents by means of which a corresponding skin and/or hair cleaning effect can be achieved for the user of the device 1.

For instance, the medium provided by the supply means 7 can contain corresponding surfactants which increase the solubility of dirt deposits and fatty deposits on the skin or in the hair, for instance respective anionic surfactants as for instance alkyl sulfates, alkyl ether sulfates and amphoteric surfactants, etc., as well as, if required, corresponding co-surfactants, and so on.

Alternatively, or in addition thereto, also one or several coloring agents can be added to the medium respectively provided by the supply means 7.

Advantageously, the supply means 7 can be designed in the form of a replaceable capsule or cartridge—similar to a capsule or cartridge used in a fully automated coffee machine for the supply of coffee.

The outside wall of the capsule or cartridge 7 can for instance be made of plastics material, and/or of a metal, e.g. aluminum, etc.

Prior to the insertion of the capsule 7 into the device 1, the content of the capsule 7—i.e. the above-mentioned (fragrance) medium—is tightly enclosed by the outside wall of the capsule.

When the capsule 7 is inserted into the device 1 or when the capsule 7 is put into use, the capsule 7 will be opened correspondingly—for instance in a similar manner as is the case with capsules used in fully automated coffee machines—for instance by piercing a hole into the outside wall, in particular into the upper side of the capsule 7, or in any other manner.

Via the hole in the outside wall of the capsule, the medium can get into the suction line 5 and—if desired (in case of a respective operation of the flow regulator 8)—into the mixing chamber 6 in the above-described manner.

When the content of the capsule 7 is used up, the capsule 7 can be replaced by a new capsule 7', and so on.

Advantageously, on the market there are offered a plurality of different capsules 7, 7', 7", 7'" which, for instance, can all be of an identical or similar design (in particular they can all have correspondingly similar or identical outer dimensions), but can contain different media, respectively.

The different capsules 7, 7', 7", 7'" can for instance each contain different fragrances and/or fragrance combinations, and/or respectively different detergents, and/or respectively different coloring agents, etc., etc.

In this manner, in each showering process different media, in particular fragrance media, can be added to the shower water, respectively—the respectively added medium, in particular fragrance medium, can be changed even during one and the same showering process.

Capsules respectively containing identical fragrances and/or identical fragrance compositions and/or detergents and/or identical coloring agents can for instance be marked or characterized correspondingly, for instance by means of a respective inscription on the outside wall of the capsule, and/or by a respective coloring of the outside wall of the capsule, etc.

Advantageously, it can also be provided that a user of the device 1 can individually select or combine by himself or herself the ingredients of a respective capsule 7, 7', 7", 7'".

With the device 1, the showering process can be revolutionized.

Figure 3:
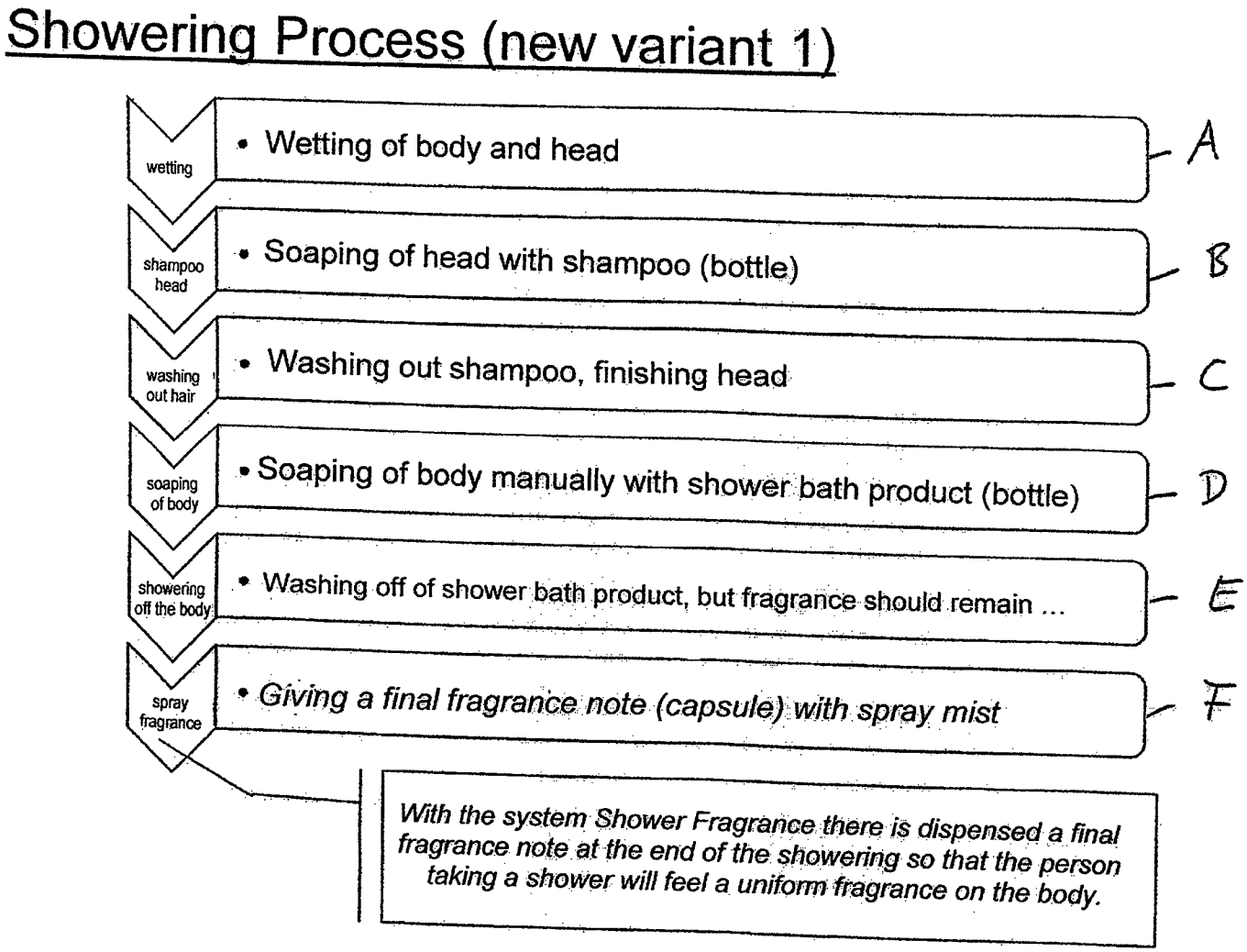
FIG. 3 is a flow diagram for the illustration of the steps carried out during a showering process according to an embodiment.

As is shown in FIG. 3 in an exemplary and diagrammatical manner, it is for instance possible—with the flow regulator 8 of the device 1 being closed—that first of all the body and the head of the user of the device 1 or the body and the head of the person using the shower 10 shown in FIG. 2 are wetted (Step A).

Next, in accordance with usual showering processes, the head of the user or of the person can be soaped with a conventional shampoo (Step B), whereupon with the aid of the shower 10—and the flow regulator 8 of the device 1 still being closed—the shampoo is washed out (Step C)

Then—also in accordance with usual showering processes—the body can be soaped with a conventional shower gel (Step D), which then—with the flow regulator 8 of the device 1 still being closed—is washed off with water with the aid of the shower 10 (Step E).

Thereupon—with a capsule 7 containing a fragrance medium already being inserted in the device 1—the flow regulator 8 of the device 1 can be opened whereby from the device 1, and, thus, also in a manner as explained above, from the shower head 30 of the shower 10 a corresponding spray mist with a fragrance note is dispensed (Step F).

Alternatively, numerous variants of the above-mentioned showering process are conceivable and possible.

Figure 4:
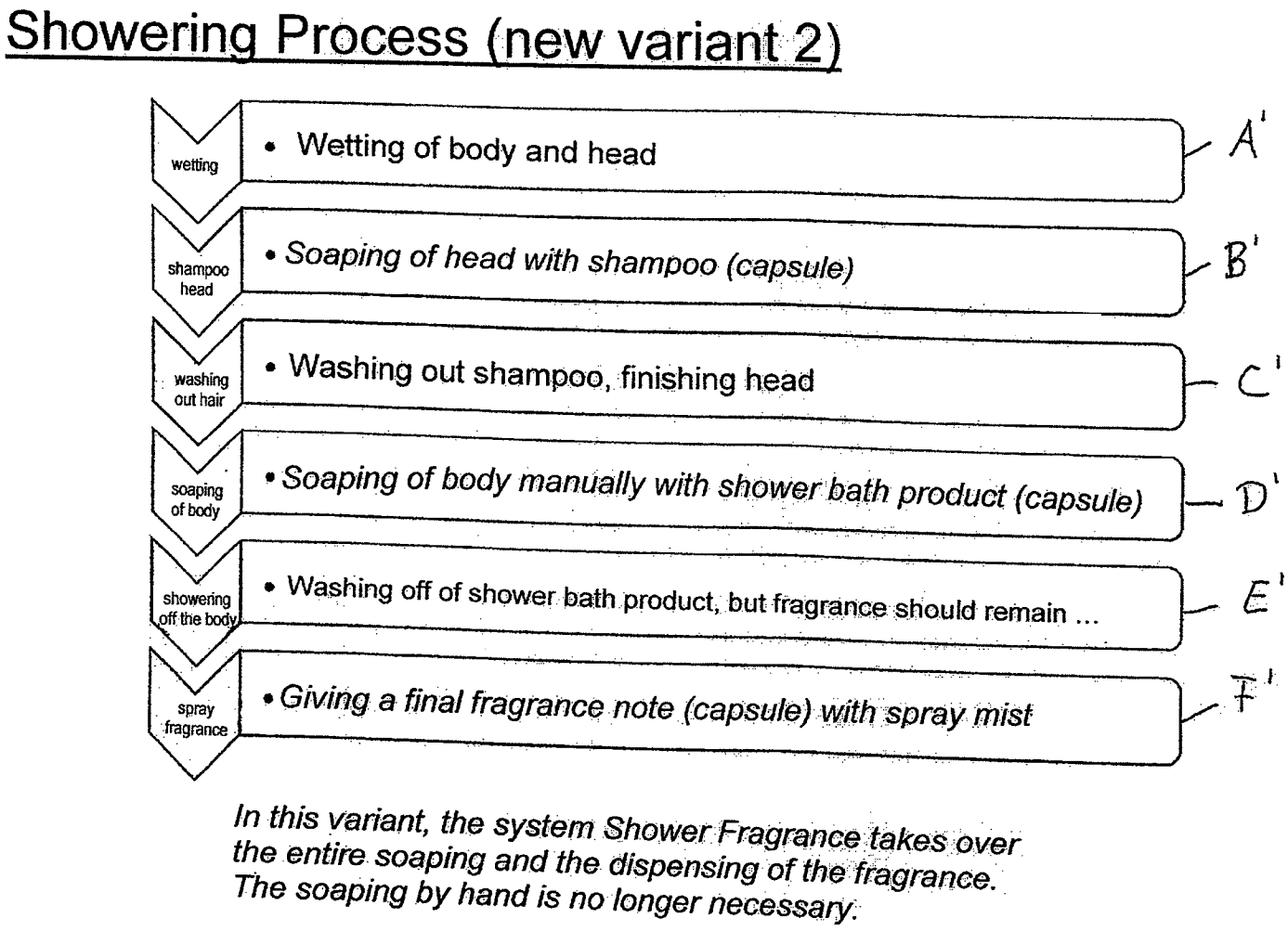
FIG. 4 is a flow diagram for the illustration of steps carried out during an alternative showering process according to an alternative embodiment.

For instance, as an alternative, and as is depicted as an example and in a diagrammatic manner in FIG. 4,—with the flow regulator 8 of the device 1 being closed—first of all the body and the head of the user of the device 1 or the body and the head of the person using the shower 10 shown in FIG. 2 can be wetted (Step A').

Thereupon—with a capsule 7 containing a detergent/a corresponding shampoo and being already inserted in the device 1—the flow regulator 8 of the device 1 can be opened whereby from the device 1 and, thus, also in the manner as described above, from the shower head 30 of the shower 10 a corresponding shampoo spray mist is dispensed (Step B').

Next, the flow regulator 8 of the device 1 can be closed once again, and the shampoo can be washed out with water with the aid of shower 10 (Step C').

Then, as in usual showering processes, the body can be soaped manually with a conventional shower gel.

As an alternative, for instance the capsule 7 can be substituted by a capsule 7' containing a shower gel.

Thereupon, the flow regulator 8 of the device 1 can be opened, whereby from the device 1 and, thus, also in the manner as described above, from the shower head 30 of the shower 10 a corresponding shower gel spray mist will be dispensed (Step D').

Next, the flow regulator 8 can be closed once again, and the shower gel can be washed off with water with the aid of the shower 10, with the flow regulator 8 being closed (Step E').

Then the capsule can be replaced by a capsule 7" containing a fragrance medium.

Thereupon the flow regulator 8 can be opened once again, whereby from the device 1 and, thus, also in the manner as explained above, from the shower head 30 of the shower 10 a corresponding spray mist with a fragrance note will be dispensed (Step F').

In FIGS. 5*a*-5*e* there are shown exemplary detailed views of a device for use in a shower system according to another embodiment of the present invention, which works according to the above-mentioned principles, in particular according to the above-mentioned concept of a water jet pump.

The device has a housing 21 with threaded ½ inch connections 21*a*, 21*b* which act as water connection and water discharge.

Figure 5B:
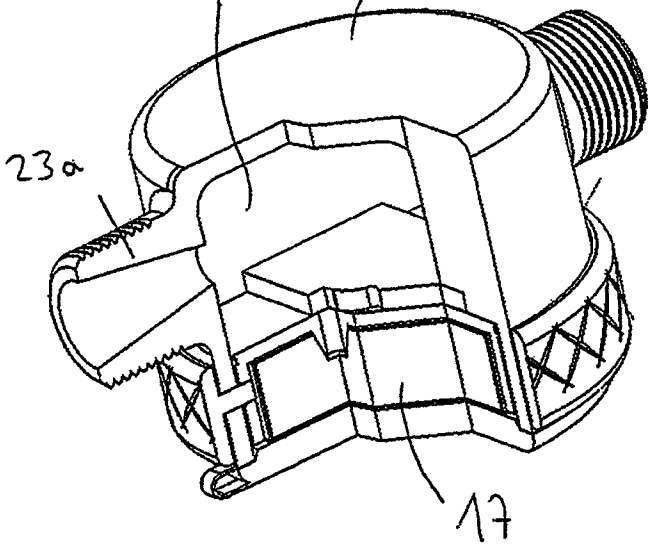
FIGS. 5*a*-5*e* are detailed views of a device for use in a shower system according to another embodiment of the present invention.
Figure 5A:
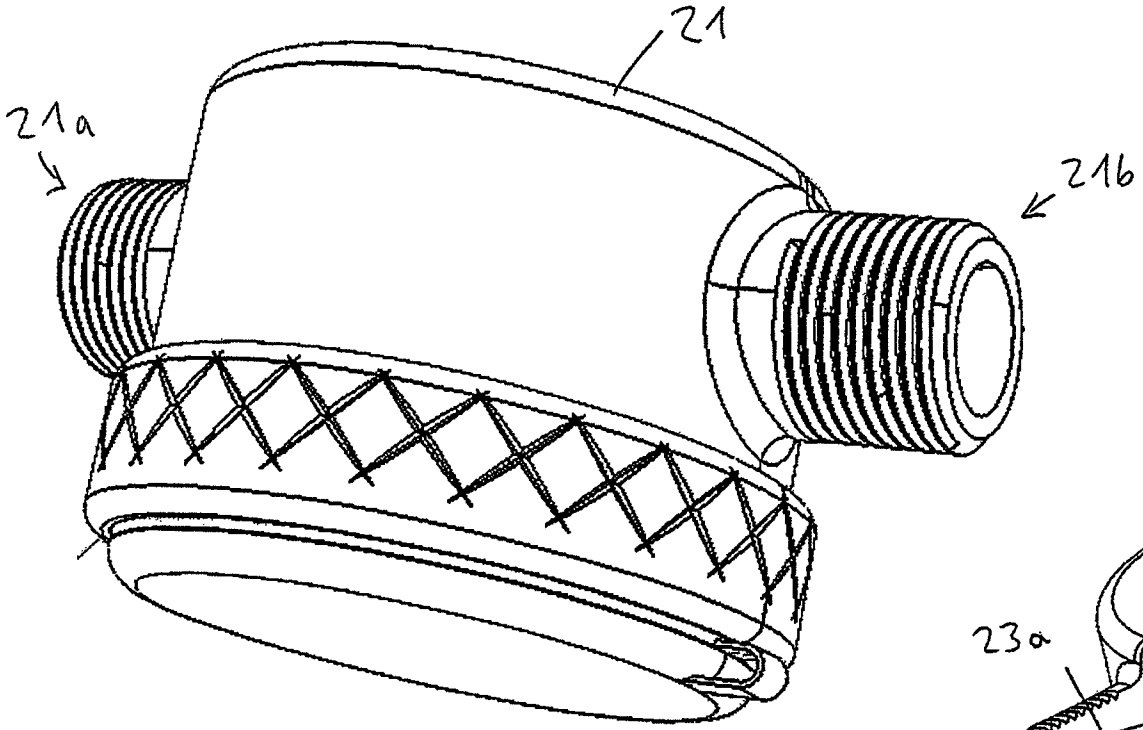
Figure 5C:
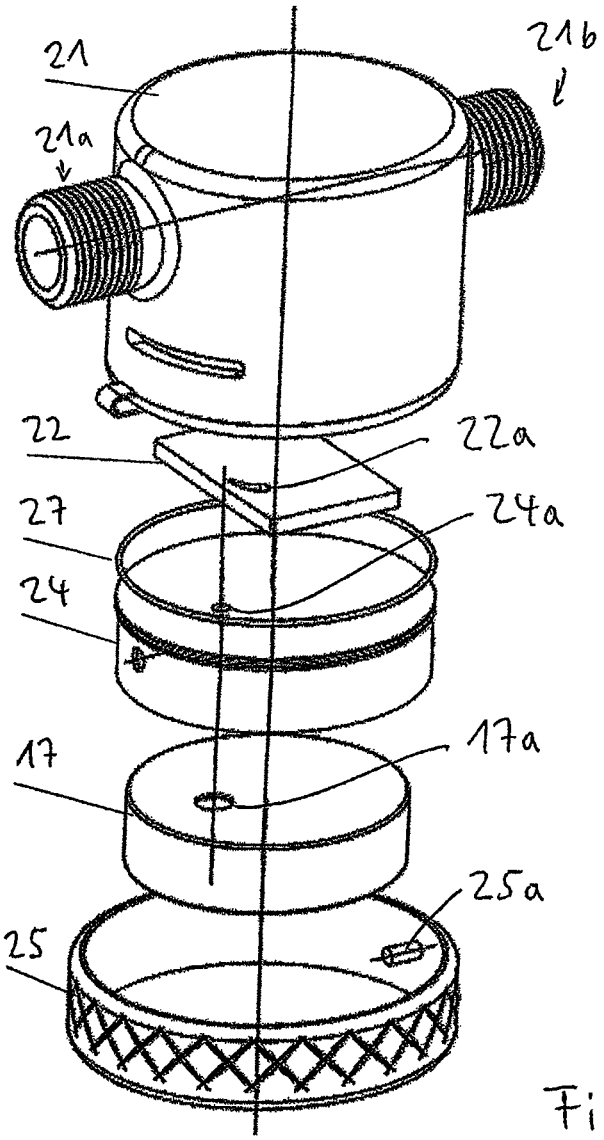
Figure 5D:
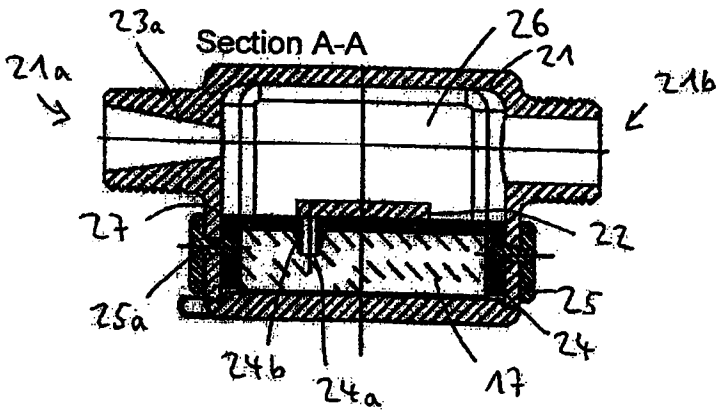
Figure 5E:
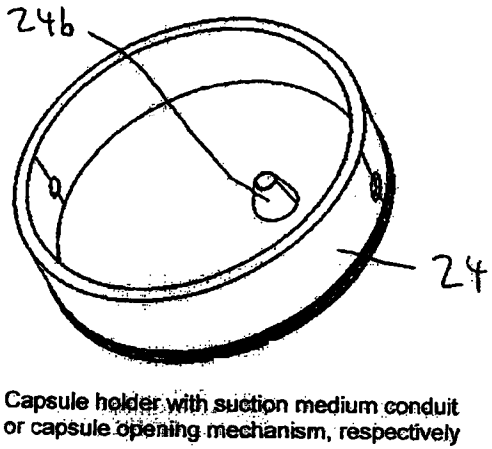

As becomes obvious for instance from FIG. 5*b* and FIG. 5*d*, a nozzle 23*a* is provided at the outlet of the water connection 21*a*.

Inside the housing 21 there is formed a mixing chamber 26.

A capsule 17 acts as a supply means for the above-mentioned medium, in particular for the fragrance medium.

The capsule 17 is inserted into a capsule holder 24 which is provided with a capsule opening mechanism 24*b*.

By means of the capsule opening mechanism 24*b* the capsule 17 can be opened, for instance through the fact that a hole 17*a* is pierced into the outside wall, in particular into the upper side of the capsule 17.

At the lower end of the housing 21 a control ring 25 is provided which is connected with the capsule holder 24 via one or more pins 25*a*.

Between the upper side of the capsule holder 24 and the mixing chamber 26 there is provided a control plate 22 which has an opening 22*a* which can communicate with an opening 24*a* provided in the capsule holder 24, in particular in the capsule opening mechanism 24*b*.

The medium contained in the capsule 17, in particular the fragrance medium, can flow via the above-mentioned hole 17*a* pierced into the capsule, or via the opening 24*a* of the capsule opening mechanism 24*b*, and via the opening 22*a* of the control plate 22 into the above-mentioned mixing chamber 26.

The capsule holder 24 is laterally and circumferentially sealed with respect to the mixing chamber 26 by an O-ring 27.

The control ring, 25, the capsule 17, and the capsule holder 24 are rotatable with regard to the housing 21, unlike the control plate 22 which is not rotatable. Alternatively, the capsule 17—like the control plate 22—can also be designed such that it is not rotatable.

The O-Ring 27 fulfils the function of a rotational resistance in the rotating process which will be explained in more detail in the following.

When the control ring 25 is rotated, due to the above-mentioned pins 25*a* the capsule holder 24 rotates correspondingly together with the control ring 25 (and due to the capsule holding mechanism 24*b* also the capsule 17)—the control plate 22 remains stationary.

In dependence on the fact in what rotational position the capsule holder 24 is situated with respect to the control plate 22, the opening 24*a* of the capsule opening mechanism 24*b* communicates—as can also be inferred from FIG. 5*c*—with a location of the opening 22*a* of the control plate 22 having a respectively smaller or larger cross-section.

If the control ring 25 is rotated further, the opening 24*a* of the capsule opening mechanism 24 will be closed by the control plate 22, i.e. it does no longer communicate with the opening 22*a* thereof.

In this manner, the supply of medium into the mixing chamber 26 can be controlled.

Thus, the user of the device can variably choose via the control ring 25 whether and to what extent the water flowing via the nozzle 23*a* into the mixing chamber 26 is mixed with a corresponding (fragrance) medium which is provided via the capsule 17.

What is claimed is:

1. A device for use in a shower system, comprising an appliance for adding a liquid medium to shower water, wherein the liquid medium is provided via a replaceable capsule, the device further comprising a capsule opening mechanism configured to push a hole through the replaceable capsule, and a capsule holder adapted to be rotated with respect to a control plate, wherein depending on a rotational position of the capsule holder with respect to the control plate, an opening of the capsule holder communicates with a location of a single, circumferentially elongated opening of the control plate with a respectively smaller or larger cross-section such that the liquid medium is configured to flow through the location of the opening with the respectively smaller or larger cross-section to steplessly control to what extent the liquid medium is added to the shower water;

wherein the capsule opening mechanism further defines a flow path such that the capsule opening mechanism is configured to fluidly connect the replaceable capsule with the circumferentially elongated opening of the control plate via the flow path.

2. The device according to claim 1, wherein the liquid medium contains one or more fragrance media, and wherein the device is configured to add the liquid medium containing the one or more fragrance media to the shower water.

3. The device according to claim 1, wherein the liquid medium contains at least one of one or more detergents and one or more coloring agents, and wherein the device is further configured to add the liquid medium containing the at least one or more of one or more detergents and one or more coloring agents to the shower water.

4. The device according to claim 1, wherein the appliance for adding the liquid medium to the shower water is designed such that it works according to the principle of a water jet pump.

5. The device according to claim 1, wherein the liquid medium is provided via a supply means.

6. The device according to claim 5, wherein the supply means comprises the replaceable capsule.

7. The device according to claim 1, wherein the appliance for adding the liquid medium to the shower water comprises a mixing chamber.

8. The device according to claim 1, wherein the appliance for adding the liquid medium to the shower water comprises a water connection, a nozzle communicating therewith, and a water discharge.

9. A shower system, comprising an appliance for adding a liquid medium to shower water, wherein the appliance is configured to store a replaceable capsule, the appliance further comprising a capsule opening mechanism configured to push a hole through the replaceable capsule, and a capsule holder adapted to be rotated with respect to a control plate, wherein depending on a rotational position of the capsule holder with respect to the control plate, an opening of the capsule holder communicates with a location of a single, circumferentially elongated opening of the control plate with a respectively smaller or larger cross-section such that the liquid medium is configured to flow through the location of the opening with the respectively smaller or larger cross-section to steplessly control to what extent the liquid medium is added to the shower water;

wherein the capsule opening mechanism further defines a flow path such that the capsule opening mechanism is configured to fluidly connect the replaceable capsule with the circumferentially elongated opening of the control plate via the flow path.

10. A method for use in a shower system comprising:

inserting a replaceable capsule into a capsule holder of the system;

opening the replaceable capsule by pushing a hole through the capsule with a capsule opening mechanism;

adding a liquid medium stored in the replaceable capsule to shower water; and rotating the capsule holder with respect to a control plate, wherein depending on a rotational position of the capsule holder with respect to the control plate, an opening of the capsule holder communicates with a location of a single, circumferentially elongated opening of the control plate with a respectively smaller or larger cross-section such that the liquid medium is configured to flow through the location of the opening with the respectively smaller or larger cross-section to steplessly control to what extent the liquid medium is added to the shower water;

wherein the capsule opening mechanism further defines a flow path such that the capsule opening mechanism is configured to fluidly connect the replaceable capsule with the circumferentially elongated opening of the control plate via the flow path.

11. The method according to claim 10, wherein the liquid medium contains at least one of one or more fragrance media and one or more detergents, and/or one or more coloring agents.

* * * * *